US006732533B1

(12) United States Patent
Giles

(10) Patent No.: US 6,732,533 B1
(45) Date of Patent: May 11, 2004

(54) COMBINED BOTTLE COOLING AND HEATING DEVICE

(76) Inventor: John P. Giles, 315 Spalding Gates Ct., Atlanta, GA (US) 30328

( * ) Notice: Subject to any disclaimer, the term of this patent is extended or adjusted under 35 U.S.C. 154(b) by 0 days.

(21) Appl. No.: 10/226,325

(22) Filed: Aug. 23, 2002

(51) Int. Cl.[7] ..... F25B 29/02; B60H 1/32

(52) U.S. Cl. ..... 62/3.3; 62/3.2; 62/3.61; 62/244

(58) Field of Search ..... 62/3.3, 3.2, 3.61, 62/244

(56) References Cited

U.S. PATENT DOCUMENTS 4,914,920 A 4/1990 Carnagie et al.
5,209,069 A * 5/1993 Newnan ..... 62/3.64
5,269,146 A 12/1993 Kerner
5,699,669 A * 12/1997 Gebhard ..... 62/3.64
5,720,171 A * 2/1998 Osterhoff et al. ..... 62/3.6
5,969,941 A * 10/1999 Cho ..... 361/687
5,970,719 A * 10/1999 Merritt ..... 62/3.6
6,064,044 A * 5/2000 Jerome ..... 219/501
6,082,114 A 7/2000 Leonoff
6,412,287 B1 * 7/2002 Hughes et al. ..... 62/3.61

* cited by examiner

*Primary Examiner*—William C. Doerrler
*Assistant Examiner*—Filip Zec
(74) *Attorney, Agent, or Firm*—William B. Noll

(57) ABSTRACT

A compact and portable heating and cooling device having particular utility in handling formula containing bottles for infants. The device comprises a pair of elongated, generally circular cavities or receptacles for receiving the bottle(s), formed of a thermal conductive material. The respective cavities are heated and cooled by a shared solid state, ceramic, thermoelectric module disposed between and in contact with the respective cavities. Supporting components include a heat sink and fan for the hot side, and optionally a pair of thermostats for controlling operation of the thermoelectric module and fan.

10 Claims, 4 Drawing Sheets

COMBINED BOTTLE COOLING AND HEATING DEVICE

FIELD OF THE INVENTION

This invention is directed to the field of devices for heating and/or cooling liquid products, especially formula containing bottles for infants, more particularly to a compact and portable, combined heating/cooling device that incorporates a thermoelectric module to effect the cooling and heating.

BACKGROUND OF THE INVENTION

The present invention relates to a portable cooling and heating device that has particular utility for handling infant baby bottles, especially for the bedside feeding of an infant late at night. The readiness of the device allows the parents to properly maintain a baby's bottle in a cooled condition until needed, then heated, and/or cooled and heated at the same time, for consumption, all without having to making a trip to the kitchen while the baby cries for nourishment. The same convenience is provided to the parents while visiting family and friends, or when on vacation.

There are commercial systems and prior art disclosures relating to evacuated bottles and insulated containers of various configurations for passively maintaining the temperature of beverages, either hot or cool. Eventually, the temperature changes, a hot liquid cooling down or a cool liquid warming up to unsuitable levels. Accordingly, there is a need for a system that maintains the desired temperature level, while providing portability to the user of the device.

Exemplary prior art devices are illustrated and described in the following U.S. Patents:

a.) U.S. Pat. No. 6,412,287, to Hughes et al., relates to a storage unit for selectively heating and/or cooling items placed therein. The storage unit has a first storage compartment and a second storage compartment. A thermoelectric module is positioned in between the first and second storage compartments. The thermoelectric module regulates and maintains various desired temperatures within the storage compartments. Particularly, the thermoelectric module is capable of heating the first storage compartment and cooling the second storage compartment.

b.) U.S. Pat. No. 6,082,114, to Leonoff, teaches devices for heating or cooling beverage containers, such as hot drinks or cold drinks, in a vehicle. A beverage container, such as a can of pop, is inserted into the device and its insertion activates the selected function, either heating or cooling. The beverage container may be inserted with one hand and removed with one hand, allowing it to be used safely by a driver. Heat transfer members within the device conform to the beverage container, and automatically adjust for different sizes of beverage container circumferences. The heat transfer members also automatically adjust themselves to accommodate varying top-to-bottom taper of beverage containers. A thermally conductive and pliable interface layer between the beverage container and the heat transfer members insures efficient heat transfer contact, and efficient heat transfer.

c.) U.S. Pat. No. 5,269,146, to Kerner, discloses a closed-loop cooling system in combination with a thermoelectric heat exchanger, whereby, the heat exchange liquid provides quick and efficient heat exchange with a thermoelectric device and is heated or cooled by passing the heat exchange liquid through an air core heat exchanger by energy efficient pump means. In a cooling system, heated water from the heat exchanger is pumped through an air core heat exchanger and then recirculated through a labyrinthine cooling block in thermal communication with the thermoelectric device. The labyrinth within the cooling block is of low back pressure to minimize the amount of energy required to pump the liquid. The liquid-driven rapid heat exchange and the pumping assures circulation and the closed system assures that the liquid is not wasted or lost. The process is carried out without phase change. An apparatus incorporating the invention can be battery-operated and portable and may provide cooling solutions for specific applications where large temperature differentials may be maintained and/or precision temperature control is important in a portable environment. Where the speed of circulation is high and the internal back pressure of the heat exchange liquid is low, there is less expenditure of energy in a closed system.

d.) U.S. Pat. No. 4,914,920, to Carnagie et al., relates to a device for actively maintaining the temperature of a beverage in a container comprising a housing with a compartment that is configured to receive the beverage container. A solid state heat pump that is mounted to the housing is selectively energized to provide either a heating or cooling environment in the compartment for controlling the beverage temperature.

While the foregoing prior art devices attempt to solve some of the problems for people on the go, such as parents of a new born child, none offer the compactness and portability of a device to provide both heating and cooling of a vessel, particularly a baby bottle. The manner by which the present invention achieves the goals hereof will become more apparent in the description which follows, especially when read in conjunction with the accompanying drawings.

SUMMARY OF THE INVENTION

This invention teaches a compact and portable, heating and cooling device for bottles, cans, and the like, particularly for handling baby bottles. The device comprises a pair of generally circular cavity members sized to receive and be in thermal communication with the baby bottle, where the cavity members are arranged in close proximity to one another. A first cavity member is mounted on a heat sink, which in turn is mounted on a fan housing containing an electrically rotatable fan. Disposed between the cavity members and in intimate contact therewith, is a miniature solid state, ceramic thermoelectric heat pump in the form of a module, where the module, when electrically energized, will heat one cavity member and cool the other cavity member. Finally, an electrical power source, such as one's house current (using an AC to DC converter) or vehicle battery, is provided to activate the fan and heating cooling module. Optionally, thermostats may be included with each cavity member to control operation of the module in heating and cooling a respective cavity member.

Accordingly, a feature of the invention is to provide an easily handled and portable device to heat and cool a bottle, can or the like. Another feature hereof is the provision of the use of a solid state, ceramic thermoelectric module, positioned between and in intimate contact with a pair of bottle receiving cavities or receptacles, where the module effects heating or cooling of the bottle.

A still further feature of the device of this invention is the incorporation of a heat sink and rotatable fan to facilitate the transfer of heat in the hot side in heating the cavity, with or without the bottle received in the hot side cavity.

These and other features of the invention will become more apparent in the specification which follows, particularly when read in conjunction with the accompanying drawings.

DETAILED DESCRIPTION OF PREFERRED EMBODIMENT

Figure 1:
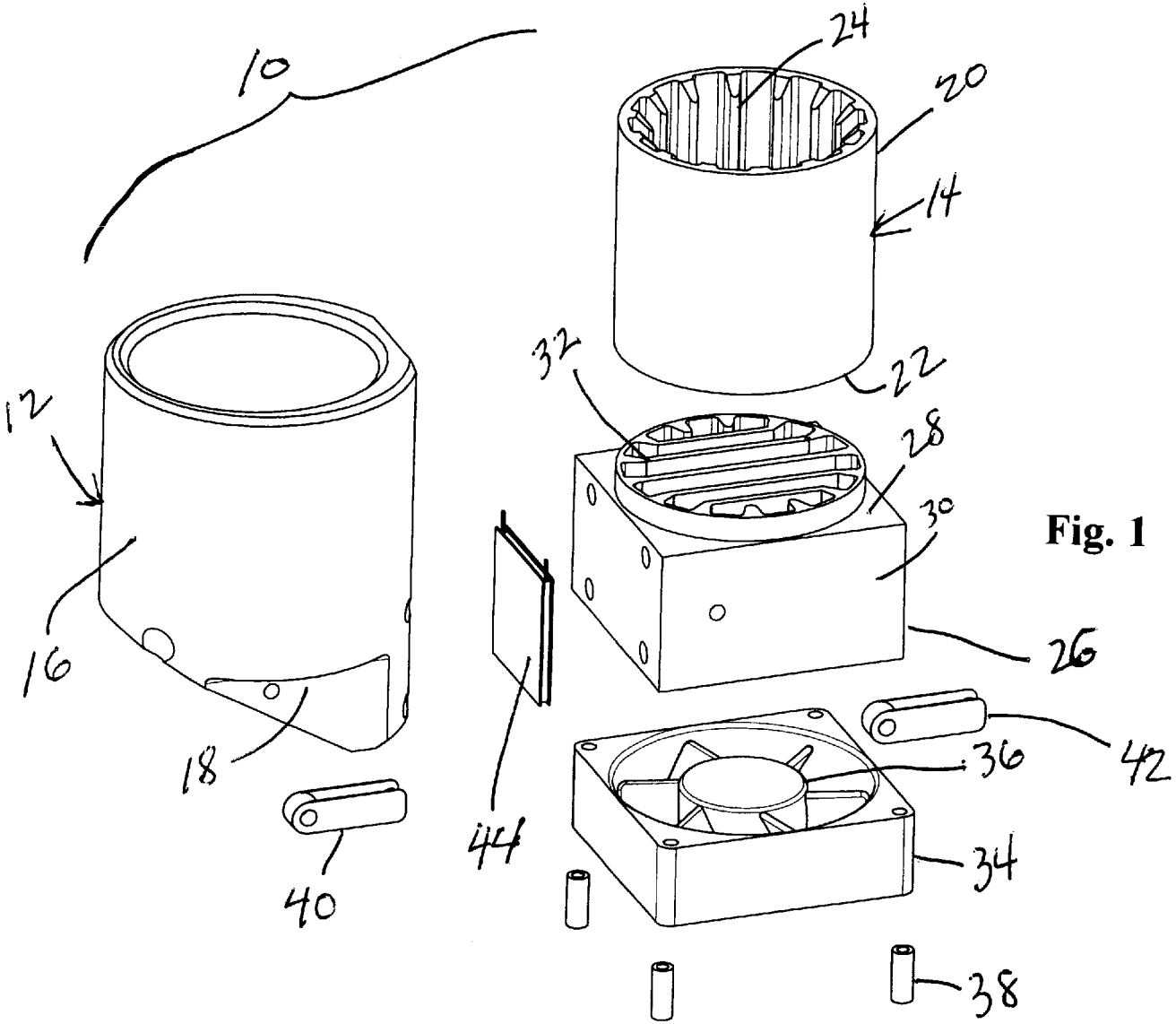
FIG. 1 is an exploded perspective view showing the various components forming the combined bottle cooling and heating device according to the present invention.

The instant invention is directed to compact and portable, dual compartmented devices for heating and cooling a liquid containing vessel, such as a baby bottle. The device includes a thermoelectric module to effect the heating and cooling of the baby bottle. The device will be more fully described with regard to the accompanying drawings, where like reference numerals represent like components or features throughout the various views.

Figure 2:
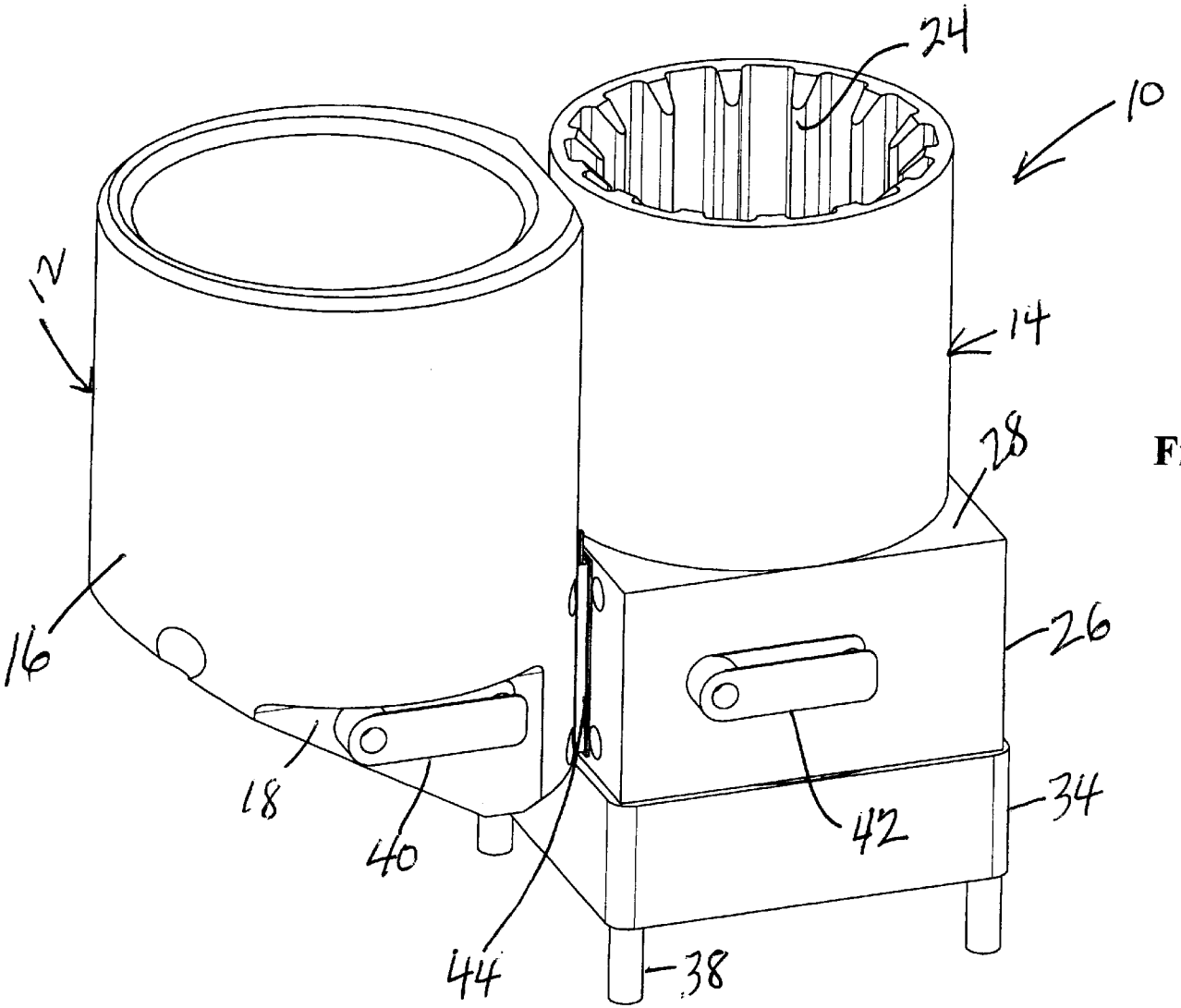
FIG. 2 is a perspective view of the assembled combined cooling and heating device of FIG. 1.

Turning first to FIGS. 1 and 2, illustrating the internal components for the device 10 of this invention, the device comprises a pair of generally circular cavity members 12, 14, fabricated of a light weight, thermally conductive material, such as aluminum or plastic, where a first said cavity 12 is a cold side heat sink for receiving a can or bottle to be cooled. The cavity 12 includes a surrounding wall 16, a bottom wall, not shown, and preferably a recess 18 to help reduce the cool-down time.

The hot side of the device 10 comprises a generally circular cavity member 14 consisting of a surrounding wall 20, a bottom opening 22, and internal fin members 24, where the latter is intended to facilitate the transfer of heat to the cavity 14, and allow air flow with the bottle in place to increase heat transfer away from the hot side, with or without the received can or bottle, not shown. To help in the dissipation of heat, the cavity member 14 is mounted on a heat sink 26 that features a top wall 28, four side walls 30, and an open grid 32 in communication with the space between the respective side walls 30. The heat sink 26 in turn is mounted for overriding a fan housing 34, where the fan housing mounts a rotating fan 36. To assist in the flow of air from below the fan housing 34 into the heat sink 26, plural standoff members 38 are provided, see FIG. 2. Further, since heat transfer from the hot side is greater than heat transferred on the cold side, the fins and fan are important elements for the hot side.

Both the hot and cold side may include a thermostat 40, 42 to control the temperature and thermoelectric module, as later discussed, of the respective sides. The desired temperature for each side is achieved by a thermoelectric module 44 disposed between the closely spaced cavity members 12, 14 and in intimate contact therewith. A thermoelectric module, as known in the art, where a commercial manufacturer is Melcor, Materials Electronic Products Corporation, selling such modules under the series CP, an example being part No. CP1.4-127-045L. In any case, a thermoelectric module is a miniature, solid state, ceramic, thermoelectric heat pump in modular form having extremely low space and current requirements, that operates without moving parts, fluids or gases. The thermoelectric module is a sandwich like device that features spaced apart outer insulation layers, where one said layer defines the cold junction, i.e. heat absorbing, and the other layer defines the hot junction, i.e. heat rejecting, electrical conductors adjacent the respective insulation layers, and a series of 'P' and 'N' type semiconductor couples therebetween. In the device the couples are connected in series electrically and parallel thermally. Heat absorbed at the cold junction is pumped to the hot junction at a rate proportional to carrier current passing through the circuit, see FIGS. 3 through 5, and the number of couples.

Figure 3:
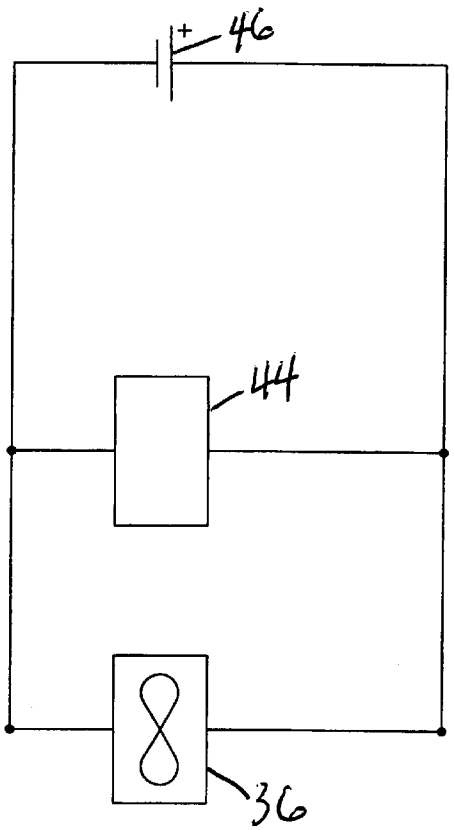
FIGS. 3, 4 and 5 are simple electrical circuits for use with the device of this invention.
Figure 4:
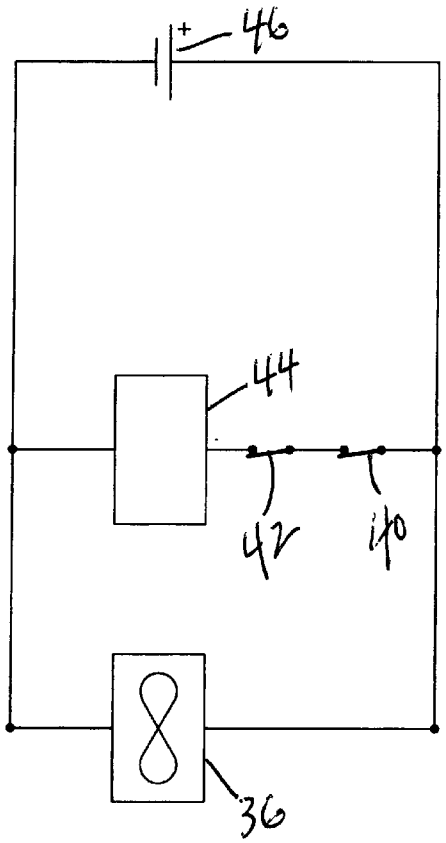
Figure 5:
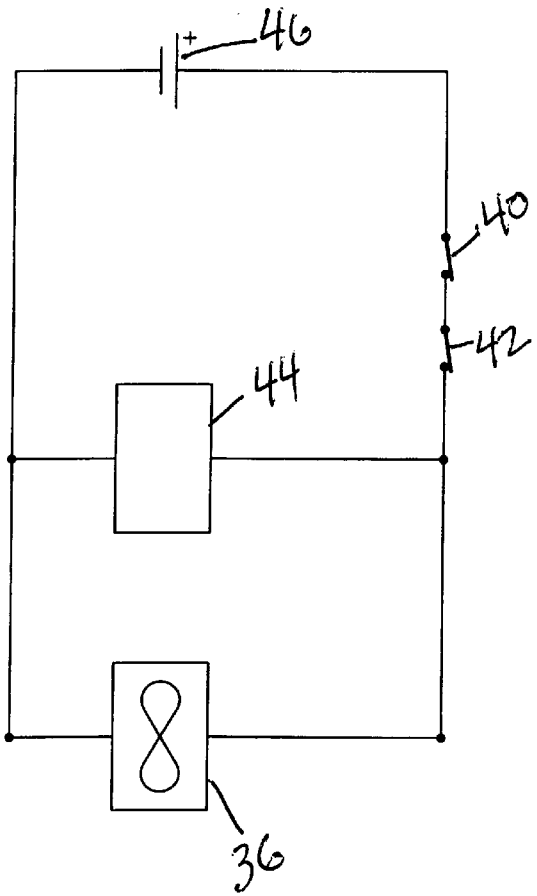

FIGS. 3 through 5 illustrate several embodiments for the electrical circuitry to operate the device 10 of this invention. Common features of the three circuits are a power source 46, such as 12 to 15 volts, the thermoelectric module 44, and a fan 36. In the embodiment of FIG. 3, the hot and cold temperatures are determined by the capacity of the thermoelctric module 44. FIG. 4 is a second embodiment which is a modification of FIG. 3 by the inclusion of a cold side thermostat 40 and hot side thermostat 42. The thermostats turn 'off' the thermoelectric module 44, and the fan 36 is always on. In operation, the hot side thermostat 42 opens or turns 'off' the thermoelectric module with a temperature rise, and the cold side thermostat opens with a temperature fall. In FIG. 5, by altering the location of the thermostats 40, 42, the device may turn 'off' both the thermoelectric module 44 and the fan 36, while also operating, in the manner of FIG. 4, to open the system with a temperature rise or fall.

Figure 6:
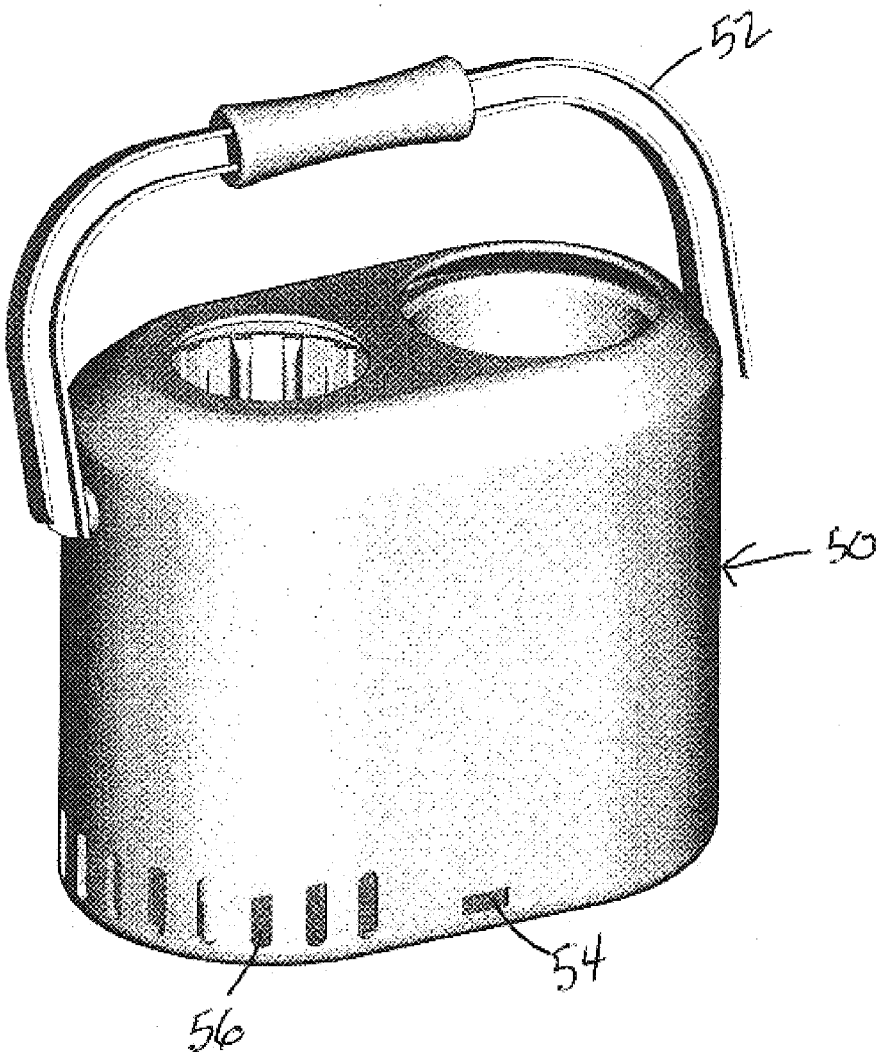
FIG. 6 is a perspective view illustrating the compactness and easy portability of the device of the present invention.

FIG. 6 illustrates a housing 50, having a convenient, pivotal carrying handle 52, to contain the assembled components of FIG. 2.

The housing wall may be provided with an access slot 54 for electrically connecting the device to an external power source, such as the user's house current (with AC to DC converter) or a vehicle's cigarette lighter receptacle. Also shown are a series of wall openings 56 to help in the transfer of air through the fan 36.

It is recognized that changes, variations and modifications may be made to the heating and cooling device of this invention, particularly by those skilled in the art, without departing from the spirit and scope thereof For example, it is contemplated that to assist in the thermal transfer of heat or cold to the contained vessels it may be desirable to include a pliable plastic containing gel liner that would conform to the shape of the bottle, for example. Further, particularly for the cold side, a gel type disk may be placed in the bottom of the cold side cavity to help in the transfer of cold to the contained vessel. Accordingly, no limitation is intended to be imposed thereon except as set forth in the accompanying claims.

I claim:

1. A compact and portable, heating and cooling device for bottles, cans and the like, said device comprising:

a.) a pair of generally circular cavity members sized to receive and be in thermal communication with said bottles, cans and the like, said cavity members arranged in close proximity to one another;

b.) a first said cavity member for heating said bottles, cans and the like, said first cavity member having an opened bottom wall and mounted on a heat sink, which in turn is mounted on a fan housing containing an electrically rotatable fan;

c.) a thermoelectric module disposed between said cavity members and in intimate contact with said second cavity member and said heat sink where said module, when electrically energized, will heat said first cavity member and cool said second cavity member, and, d.) an electrical power source to activate said fan and said thermoelectric module.

2. The compact and portable, heating and cooling device according to claim 1, including thermostats associated with each said cavity member to control operation of said thermoelectric module in heating and cooling said respective first and second cavity members.

3. The compact and portable, heating and cooling device according to claim 1, wherein said heating side cavity member includes a circular cavity containing a plurality of inwardly directed radial fins to facilitate the flow of air and transfer of heat from said first cavity member.

4. The compact and portable, heating and cooling device according to claim 1, wherein said heat sink includes an upper surface having an open, circular grate portion in air communication with said fan housing and said rotatable fan.

5. The compact and portable, heating and cooling device according to claim 1, wherein said second cavity member includes a flattened external wall portion in intimate contact with said thermoelectric module.

6. The compact and portable, heating and cooling device according to claim 5, wherein said heat sink includes a planar wall in intimate contact with said thermoelectric module.

7. The compact and portable, heating and cooling device according to claim 2, wherein a first said thermostat is mounted on a second wall of said heat sink, and a said second thermostat is mounted on said second cavity member.

8. The compact and portable, heating and cooling device according to claim 1, including plural spacer legs mounted on said fan housing to elevate said device from a supporting surface.

9. The compact and portable, heating and cooling device according to claim 1, wherein said cavity members feature an open top, and said device includes an overriding housing with said open tops exposed to the exterior of said overriding housing.

10. The compact and portable, heating and cooling device according to claim 9, including a pivotal carrying handle secured to said overriding housing.

* * * * *